US005892527A

United States Patent [19]

Harshbarger et al.

[11] Patent Number: 5,892,527

[45] Date of Patent: Apr. 6, 1999

[54] INK CARTRIDGE WITH AN UNFELTED FOAM AND METHOD OF PRINTING USING THE SAME

[75] Inventors: Kenneth James Harshbarger; Ajay Kanubhai Suthar, both of Lexington, Ky.

[73] Assignee: Lexmark International, Inc., Lexington, Ky.

[21] Appl. No.: 635,795

[22] Filed: Apr. 22, 1996

[51] Int. Cl.[6] ..... B41J 2/175

[52] U.S. Cl. ..... 347/87; 347/100

[58] Field of Search ..... 347/86, 87, 100

[56] References Cited

U.S. PATENT DOCUMENTS

| | | | |
|---|---|---|---|
| 4,771,295 | 9/1988 | Barker et al. | 347/87 |
| 4,929,969 | 5/1990 | Morris | 347/87 |
| 4,931,811 | 6/1990 | Cowger et al. | 347/87 |
| 5,047,790 | 9/1991 | Cowger et al. | 347/87 |
| 5,182,581 | 1/1993 | Kashimura et al. | 346/140 R |
| 5,448,275 | 9/1995 | Fong | 347/87 |
| 5,467,117 | 11/1995 | Evans | 347/87 |
| 5,477,255 | 12/1995 | Huth | 347/87 |

FOREIGN PATENT DOCUMENTS

| | | | |
|---|---|---|---|
| 520695 | 12/1992 | European Pat. Off. | 347/86 |
| 212585 | 9/1988 | Japan | 347/100 |

*Primary Examiner*—Valerie Lund

[57] ABSTRACT

The invention is directed to an ink cartridge for use in printing an ink on a print medium with an electronic printer. The ink cartridge includes an ink disposed therein having a viscosity of between approximately 1.5 and 10 centipoise. An ink cartridge has an unfelted foam therein. The foam carries the ink and has a plurality of pores disposed substantially in communication with each other. The pores have an effective porosity of between approximately 60 and 90 pores per inch. The ink cartridge further has a printhead assembly disposed in fluid communication with the foam. The foam has an effective porosity, dependent on the viscosity of the ink, wherein ink is allowed to flow from the foam to the printhead assembly during periods of operation, and is substantially prevented from flowing from the printhead assembly during periods of inoperation.

16 Claims, 1 Drawing Sheet

INK CARTRIDGE WITH AN UNFELTED FOAM AND METHOD OF PRINTING USING THE SAME

BACKGROUND OF THE INVENTION

1. Field of the Invention

The present invention relates to an ink cartridge for use in an ink jet printer, and, more particularly, to an ink cartridge having a porous foam therein.

2. Description of the Related Art

An ink cartridge for use in an ink jet printer typically includes a porous member disposed therein. The porous member is disposed in fluid communication with a printhead assembly, and supplies ink to the printhead assembly during periods of operation. Typically, the porous member is in the form of a felted piece of polyurethane foam. The foam is thermally compressed, or felted, until it holds a compression set at roughly a 3 to 1 compression ratio. That is, the foam is heated close to its melting point under a compression loading and allowed to thereafter cool, thereby resulting in a denser foam with an increased effective porosity. When felted, the foam achieves an effective porosity of approximately between 150 and 200 pores per inch (ppi).

Conventional ink cartridges typically use a water soluble, dye based ink which is applied to a print medium. The dots of dye based ink combine to form characters and graphics on the print. medium which is subject to print quality variations, including fuzziness, bleed, ink spread, and lack of optical density.

The print quality of the ink jet printer can be greatly improved through the use of a higher viscosity, higher surface tension ink, such as a pigmented ink. The pigments, e.g., carbon black pigments or color pigments, are suspended in the water as opposed to being dissolved in the water. After the ink is applied to the paper and the water dries, the non-water soluble pigments are essentially unaffected by subsequent contact with water. Moreover, the increase in viscosity and surface tension allows the ink to set on top of the print medium with reluctance to spread into other (color) inks, thus preventing bleed of different inks. Further, the higher surface tension ink also inhibits the penetration of the ink into the paper, improving optical density. Finally, the more viscous ink does not tend to travel along the fibers of the paper, creating a crisper, cleaner print without fuzziness.

A problem with using a higher viscosity, pigmented ink is that "starvation" of the printhead assembly occurs when the higher viscosity ink is placed in a conventional, felted foam. More particularly, as the ink is jetted from the printhead assembly during operation in known manner, an adequate supply of the higher viscosity ink must flow from the felted foam to the printhead assembly so that the ink may be continuously jetted therefrom. However, the felted foam has an effective porosity of between approximately 150 to 200 ppi which does not allow an adequate flow rate of ink from the foam to the printhead assembly. The capillary force within the felted foam having such an effective porosity holds the higher viscosity ink therein and does not provide a sufficient flow of ink to the printhead assembly. This results in "starvation" of the printhead assembly because of the inadequate flow of ink.

One known solution allowing the use of a higher viscosity ink in an ink cartridge is to utilize a bladder-spring mechanism within the cartridge. The bladder maintains an appropriate back pressure on the ink within the ink cartridge and avoids the problem of starvation such as occurs when a higher viscosity ink is used with a felted foam.

The present inventors have also attempted to utilize a higher viscosity ink with a felted foam having a lower effective porosity, but have encountered problems associated therewith. To wit, a felted foam having an effective porosity of between approximately 60 to 80 ppi was used in conjunction with a higher viscosity, pigmented ink. It has been found that to prevent starvation of the printhead assembly during operation, the felted foam must have an effective porosity which does not exceed a range of between approximately 80 and 90 ppi. However, it has also been found that with a felted foam having a porosity of less than about 90 ppi, the printhead assembly may drip ink or "drool", during periods of inoperation. Such drooling is obviously not desirable. Thus, in order to prevent the problem of starvation which may occur during dynamic fluid conditions, the drooling problem results during static fluid conditions.

It is believed by the present inventors that the overlapping problems of starvation and drooling which occur when attempting to use a felted foam in conjunction with a higher viscosity ink are a result of the felting process. When the foam is felted, as described above, the temperature of the foam is increased near the melting point and a compression loading is temporarily applied to the foam. Because of temperature and loading gradients which exist on the foam during the felting process, the pores at the periphery of the foam may be smaller than the pores in the center of the foam. The smaller pores at the periphery of the foam may not allow, adequate fluid flow therethrough and thus cause the starvation problem during periods of operation, while the larger pores in the center of the foam may not provide sufficient capillary force to prevent drooling of the printhead assembly during periods of inoperation.

Using a felted foam also has other associated problems. For example, during the felting process chemical residue is created and deposited on the surface of the foam. This residue can react with the ink to modify the ink and create defects in print quality, or can be carried by the ink to the printhead assembly where it may clog the nozzles and possibly result in printhead assembly failure.

What is needed in the art is an ink cartridge for use in an ink jet printer which economically and reliably allows for the use of a higher viscosity, pigmented ink.

SUMMARY OF THE INVENTION

The present invention provides an ink cartridge with an unfelted foam having an effective porosity size of between approximately 60 and 85 pores per inch, which is used in conjunction with a higher viscosity, pigmented ink having a viscosity of between approximately 1.5 and 10 centipoise.

The invention comprises, in one form thereof, an ink cartridge for use in printing an ink on a print medium with an electronic printer. The ink cartridge includes an ink disposed therein having a viscosity of between approximately 1.5 and 10 centipoise. An ink cartridge has an unfelted foam therein. The foam carries the ink and has a plurality of pores disposed substantially in communication with each other. The pores have an effective porosity of between approximately 60 and 85 pores per inch. The ink cartridge further has a printhead assembly disposed in fluid communication with the foam. The foam has an effective porosity, dependent on the viscosity of the ink, wherein ink is allowed to flow from the foam to the printhead assembly during periods of operation, and is substantially prevented from flowing from the printhead assembly during periods of inoperation.

An advantage of the present invention is that a higher viscosity, pigmented ink may be used in an ink cartridge during periods of operation without "starvation" resulting, and during periods of inoperation without "drooling" resulting.

Another advantage is that by eliminating the felting step from the manufacturing process, the cost per piece of foam iE3 substantially reduced.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
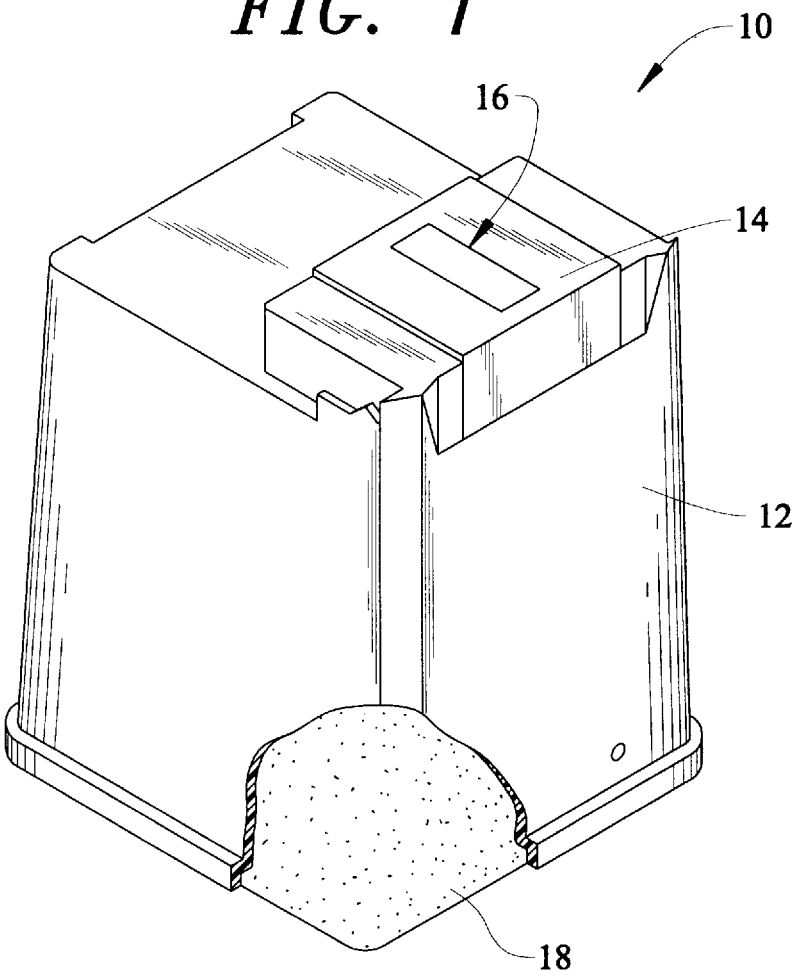
FIG. 1 a perspective view of an embodiment of an ink jet cartridge which may be used with the method of the present invention.

Referring now to the drawings and particularly to FIG. 1, there is shown a perspective view of an embodiment of an ink cartridge 10 which may be used with the method of the present invention. Ink cartridge 10 is installable into an electronic printer, and is used for printing an ink on a print medium such as paper.

Ink cartridge 10 generally includes a body 12, Tape Automated Bonding (TAB) circuit 14, printhead assembly 16 and porous member or foam 18. Printhead assembly 16 includes a nozzle plate (not numbered) which is disposed adjacent to a semi-conductor chip carrying a plurality of heater elements (not numbered), in known manner. The nozzles in the nozzle plate of printhead assembly 16 allow a jetting of ink onto the print medium during operation. Printhead assembly 16 is disposed in fluid communication with foam 18. TAB circuit 14 is electrically connected to the heater elements of printhead assembly 16, and provides a mechanical interface for electrical interconnection with the ink jet printer.

Figure 2:
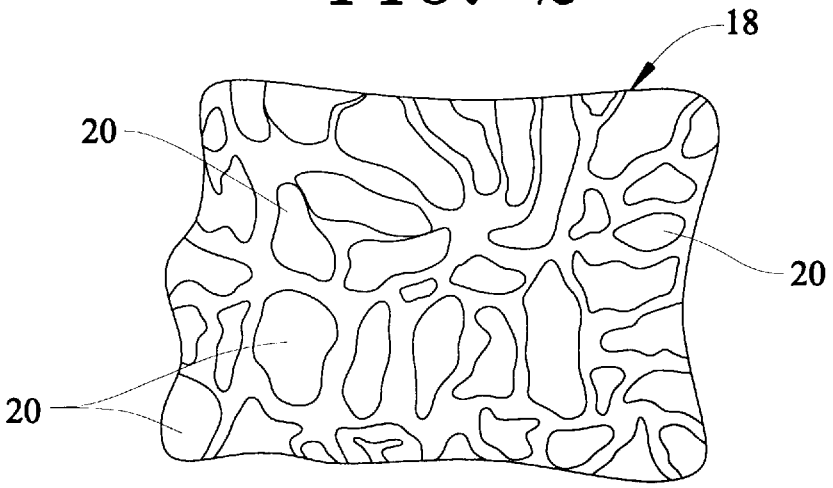
FIG. 2 is an enlarged, fragmentary view of the unfelted foam shown in FIG. 1, detailing the pores therein.

Referring now to FIG. 2, foam 18 may be seen in greater detail. Foam 18, in the embodiment shown, is an unfelted foam, such as an unfelted polyethylene-based polyurethane foam. Foam 18 includes a plurality of pores 20 which are disposed substantially in communication with each other. Pores 20 have an effective porosity of between approximately 60 and 85 ppi, and preferably between approximately 70 and 80 ppi.

Foam 18 is used for carrying an ink, such as a pigmented ink. The ink has a higher viscosity (relative to die-based inks) of between approximately 1.5 and 10 centipoise (cP), and preferably between approximately 2.5 and 5 cP.

Foam 18 is configured with an effective porosity, dependent of the viscosity of the ink, which allows the ink to flow from the foam to the printhead assembly during periods of operation (thereby preventing starvation), and substantially prevents the ink from flowing from the printhead assembly during periods of inoperation (thereby preventing drooling).

During operation, ink cartridge 10 is provided with an unfelted foam therein, as described above. Printhead assembly 16 is disposed in fluid communication with foam 18, and receives a supply of ink therefrom. The ink is carried by the foam, and has a viscosity of between approximately 1.5 and 10 cP, as indicated above. Foam 18 is configured with a porosity size which, dependent on the viscosity of ink, substantially prevents both starvation during periods of operation and drooling during periods of inoperation. A portion of the ink is jetted from printhead assembly 16 onto the print medium during operation. As the jetting of the ink onto the print medium occurs, ink is allowed to flow from foam 18 to printhead assembly 16 at a sufficient flow rate to prevent starvation of printhead assembly 16. After the ink is no longer jetted onto the print medium, foam 18 prevents ink from drooling from printhead assembly 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In an electronic printer for printing an ink on a print medium, an ink cartridge comprising:

a body;

a printhead assembly coupled with said body;

an ink having a viscosity of between approximately 1.5 and 10 centipoise; and an unfelted foam disposed within said body, said foam carrying said ink and having a plurality of pores disposed substantially in communication with each other and with said printhead assembly, said pores having an effective porosity which in conjunction with the viscosity of the ink define a means for allowing said ink to substantially continuously flow from said foam to said printhead assembly during periods of operation, and substantially preventing said ink from flowing from said printhead assembly during periods of inoperation.

2. The ink cartridge of claim 1, wherein said effective porosity is between approximately 70 and 80 pores per inch.

3. The ink cartridge of claim 1, wherein said ink has a viscosity of between approximately 2.5 and 5 centipoise.

4. The ink cartridge of claim 1, wherein said ink comprises a pigmented ink.

5. The ink cartridge of claim 1, wherein said printhead assembly is directly coupled with said body.

6. A method of printing an ink on a print medium using an electronic printer, said method comprising the steps of:

providing an ink cartridge having a body, a printhead assembly coupled with said body, and an unfelted foam within said body, said foam having a plurality of pores disposed substantially in communication with each other and with said printhead assembly;

carrying the ink with said foam, the ink having a viscosity of between approximately 1.5 and 10 centipoise;

configuring said foam with an effective porosity, dependent on the viscosity of the ink, such that ink is allowed to substantially continuously flow from said foam to said printhead assembly during periods of operation, and is substantially prevented from flowing from said printhead assembly during periods of inoperation; and jetting ink from said printhead assembly onto the print medium.

7. The method of claim 6, wherein said effective porosity is between approximately 70 and 80 pores per inch.

8. The method of claim 6, wherein the ink has a viscosity of between approximately 2.5 and 5 centipoise.

9. The method of claim 6, wherein the ink comprises a pigmented ink.

10. The method of claim 6, wherein said foam comprises an unfelted polyurethane foam.

11. The method of claim 6, comprising the further step of allowing a portion of the ink to flow from said foam to the printhead assembly during said jetting step.

12. A method of printing an ink on a print medium using an electronic printer, said method comprising the steps of:

providing an ink cartridge having a body, a printhead assembly coupled with said body, and a porous member within said body, said porous member having a plurality of pores disposed substantially in communication with each other and with said printhead assembly;

carrying the ink with said porous member, the ink having a viscosity of between approximately 1.5 and 10 centipoise;

configuring said foam with an effective porosity, dependent on the viscosity of the ink, such that ink is allowed to substantially continuously flow from said porous member to said printhead assembly during periods of operation, and is substantially prevented from flowing from said printhead assembly during periods of inoperation; and jetting ink from said printhead assembly onto the print medium.

13. The method of claim 12, wherein said effective porosity is between approximately 70 and 80 pores per inch.

14. The method of claim 12, wherein the ink has a viscosity of between approximately 2.5 and 5 centipoise.

15. The method of claim 12, wherein the ink comprises a pigmented ink.

16. The method of claim 12, wherein said foam comprises an unfelted polyurethane foam.

* * * * *